US006793509B2

(12) United States Patent
Chen

(10) Patent No.: US 6,793,509 B2
(45) Date of Patent: Sep. 21, 2004

(54) CONNECTOR HAVING PLURAL FOLDABLE PLUGS

(75) Inventor: Chun-Chen Chen, Taipei (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 10/431,469

(22) Filed: May 8, 2003

(65) Prior Publication Data

US 2004/0127080 A1 Jul. 1, 2004

(30) Foreign Application Priority Data

Dec. 31, 2002 (TW) ..... 91221696 U

(51) Int. Cl.[7] ..... H01R 13/44
(52) U.S. Cl. ..... 439/136; 439/131
(58) Field of Search ..... 439/131, 172, 439/174, 640, 132–145

(56) References Cited

U.S. PATENT DOCUMENTS 4,279,457 A * 7/1981 Nickence ..... 439/145
4,702,709 A * 10/1987 Santilli ..... 439/144
5,165,042 A * 11/1992 Klinger ..... 174/67
5,934,919 A * 8/1999 Cross et al. ..... 439/136
6,398,566 B1 * 6/2002 Chen ..... 439/131

* cited by examiner

*Primary Examiner*—Hien Vu
(74) *Attorney, Agent, or Firm*—Bacon & Thomas

(57) ABSTRACT

A connector having plural foldable plugs is disclosed. The connector having plural foldable plugs includes a main body having a first slot and a second slot, a first foldable plug received in the first slot, a second foldable plug received in the second slot, and a cover sliding between the first slot and the second slot, thereby the cover protects the first foldable plug from being used when the cover slides on the first slot, and protects the second foldable plug from being used when the cover slides on the second slot.

9 Claims, 5 Drawing Sheets

CONNECTOR HAVING PLURAL FOLDABLE PLUGS

FIELD OF THE INVENTION

This invention relates to a connector, and more particularly to a connector having plural foldable plugs.

BACKGROUND OF THE INVENTION

The conventional connector mainly has an insulation casing, a plug, an output terminal and an inner circuit. The plug is used to connect to an external power source for providing the power to the inner circuit. The connector can be an adapter, a power supply or a charger, and accordingly, the inner circuit can rectify or convert the power for the direct use of the electric equipment or for the charger to charge the battery. The plug of the conventional connector is usually fixed and protruding on one end of the insulation casing, and includes plural metal pieces. When the connector is not used, it causes a danger of touch since the tips of the plural metal pieces are protruding outside the insulation casing. Therefore, a connector having a foldable plug is developed to prevent the danger of touch.

However, there are many kinds of the plugs of the connectors to be used in different countries. For example, the plug may have two or three metal pieces, and the arrangement and the forms of the metal pieces are also different in different countries. Therefore, a connector having two foldable plugs is developed so that the plugs of the connector can be received in the slots of the insulation casing, and can be applied to different plug standards in different countries.

Please refer to FIG. 1 showing a connector having two foldable plugs according to the prior art. The connector includes a main body 10 which has a first slot 101 and a second slot 102. The first slot 101 and the second slot 102 are used to receive a first foldable plug 103 and a second foldable plug 104, respectively. When the connector is not used, the first foldable plug 103 and the second foldable plug 104 can be received in the first slot 101 and the second slot 102, respectively, to avoid the metal pieces protruding outside the main body 10. When the connector is used, the first foldable plug 103 or the second foldable plug 104 can be rotated upwardly to a conducting position for electrically connecting with a power input region in the connector.

Please refer to FIG. 2 showing a side cross-sectional view of the connector in FIG. 1. The main body 10 has a power input region 105 therein, and a metal conducting piece 1051 is set on the power input region 105. When the connector is going to be used by a user, one of the first foldable plug 103 and the second foldable plug 104 must be rotated upwardly. For example, when the first foldable plug 103 is used, the metal pieces 1031 of the first foldable plug 103 must be rotated upwardly, and accordingly, the metal extending pieces 1033 can be rotated downwardly via a shaft 1032 by a rotation mechanism simultaneously. Therefore, the metal extending pieces 1033 can contact the metal conducting piece 1051 on the power input region 105, so that the first foldable plug 103 is electrically connected with the power input region 105.

The connector having two foldable plugs described above can be applied to different plug standards in different countries, and the foldable plugs can be received in the slots when they are not used to prevent the danger of touch. However, the connector described above may have danger of electric shock. For example, when the first foldable plug 103 and the second foldable plug 104 are both at the conducting positions, somebody, especially a child, may incautiously touch the unused plug and get an electric shock. Therefore, the present invention provides a connector which can overcome the disadvantages of the conventional connector as described above.

SUMMARY OF THE INVENTION

It is an object of the present invention to provide a connector having plural foldable plugs which can be applied to different plug standards in different countries.

It is another object of the present invention to provide a connector having plural foldable plugs, each of which is capable of being received in respective slot when the connector is not used.

It is an additional object of the present invention to provide a connector having plural foldable plugs which can prevent the danger of electric shock.

In accordance with an aspect of the present invention, the connector having plural foldable plugs includes a main body having a first slot and a second slot, a first foldable plug received in the first slot, a second foldable plug received in the second slot, and a cover sliding between the first slot and the second slot, thereby the cover protects the first foldable plug from being used when the cover slides on the first slot, and protects the second foldable plug from being used when the cover slides on the second slot.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a connector having plural foldable plugs. The following embodiments are illustrated with a connector having two foldable plugs, but the number of the foldable plugs is not limited to two, and any designs of plural foldable plugs applying the present techniques are incorporated herein for reference.

Figure 1:
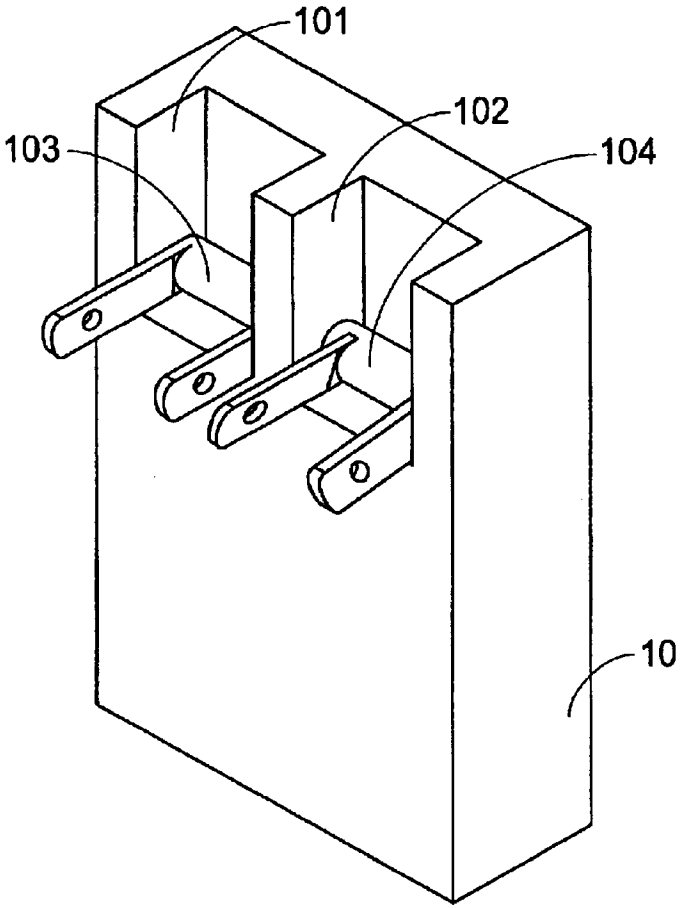
Fig. 1(PRIOR ART)
FIG. 1 is a schematic view showing the connector having two foldable plugs according to the prior art.
Figure 2:
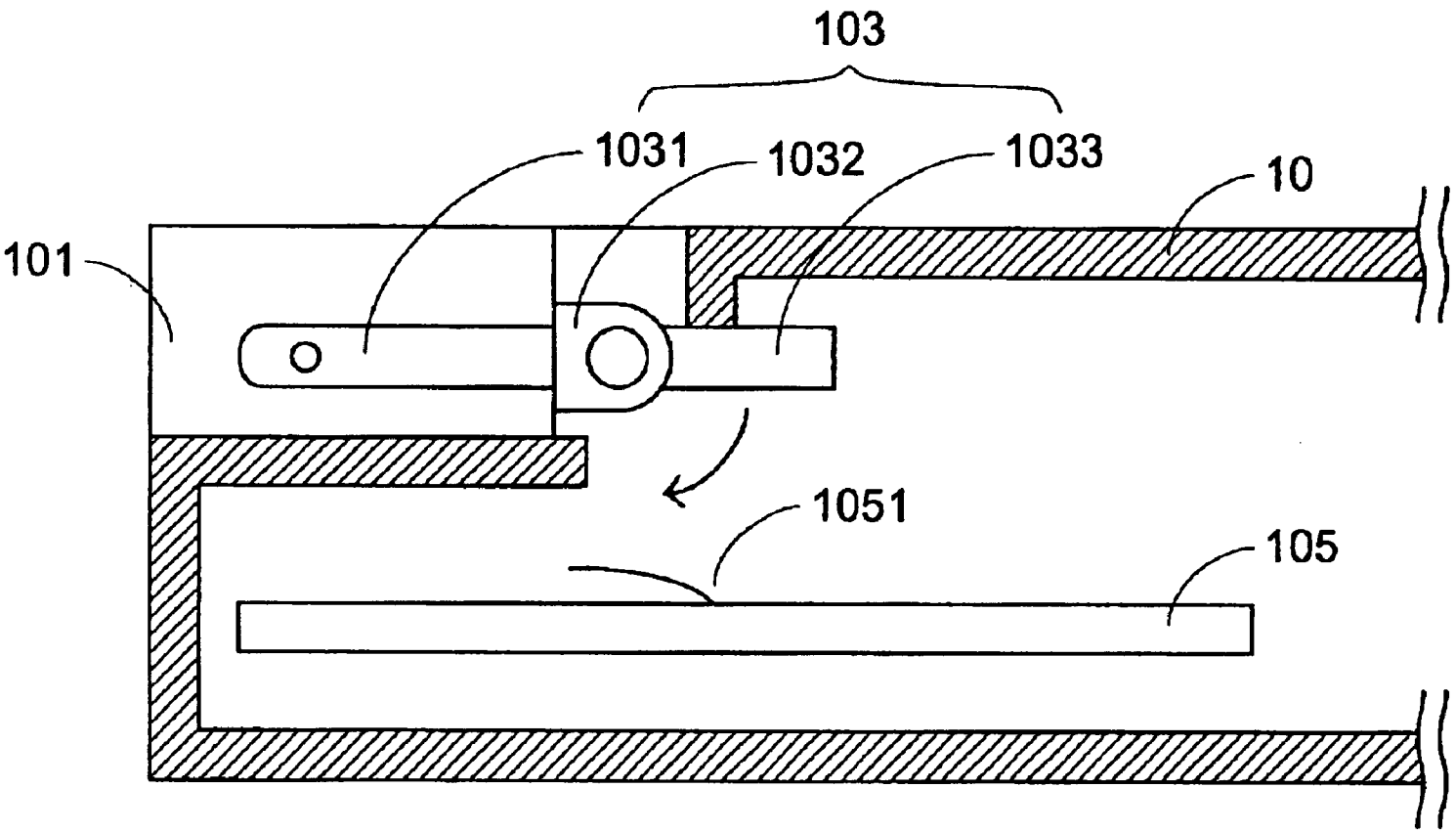
Fig. 2(PRIOR ART)
FIG. 2 is a schematic view showing a side cross-section of the connector in FIG. 1.
Figure 3:
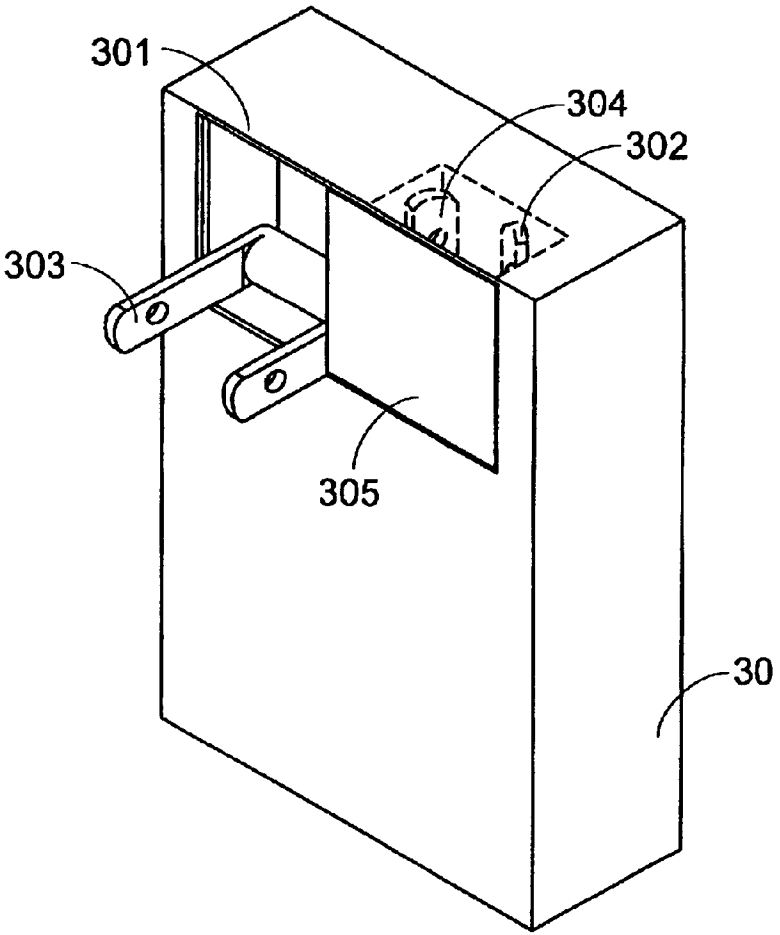
FIG. 3 is a schematic view showing the connector having two foldable plugs according to the present invention.

Please refer to FIG. 3 showing the structure of the connector having two foldable plugs according to a preferred embodiment of the present invention. The connector includes a main body 30, a first foldable plug 303, a second foldable plug 304 and a cover 305. The main body 30 has a first slot 301 and a second slot 302 for receiving the first foldable plug 303 and the second foldable plug 304 therein, respectively. The cover 305 can slide between the first slot 301 and the second slot 302 for covering and protecting the first foldable plug 303 received in the first slot 301 or the second foldable plug 304 received in the second slot 302. In addition, the first foldable plug 303 and the second foldable plug 304 have plural metal extending pieces, respectively, to suit with the AC or DC plug standards in different countries, and the metal piece can be in the form of a flat bar or a cylinder.

Figure 4:
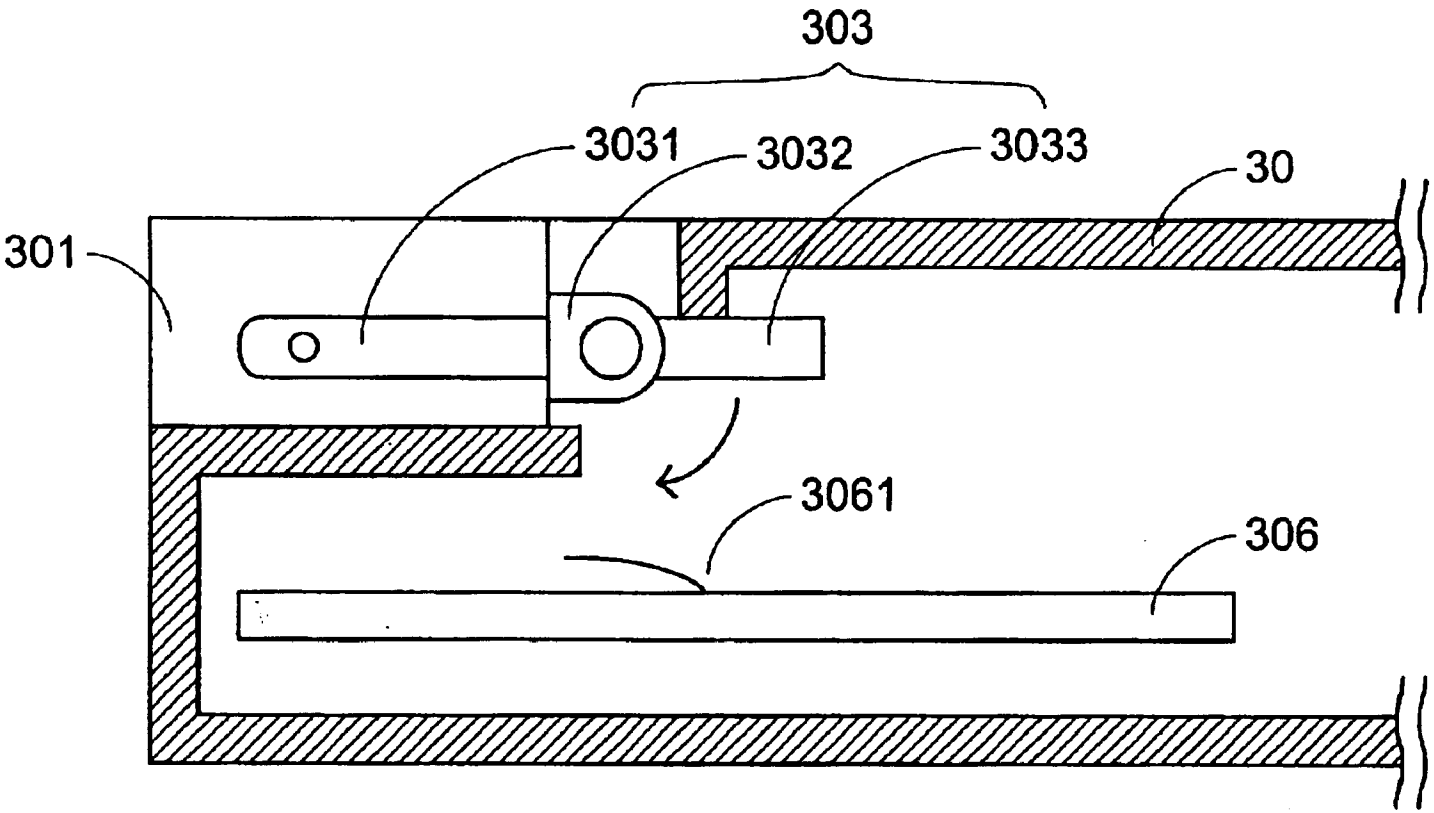
FIG. 4 is a schematic view showing a side cross-section of the connector in FIG. 3.

Please refer to FIG. 4 showing a side cross-sectional view of the connector in FIG. 3. The main body 30 has a power input region 306 therein, and a metal conducting piece 3061 (preferably a resilient piece) is set on the power input region 306. When the connector is used by a user, the cover 305 must be slid on one of the first slot 301 and the second slot 302, and then the uncovered foldable plug must be rotated upwardly. For example, when the first foldable plug 303 is used, the metal pieces 3031 of the first foldable plug 303 must be rotated upwardly, and accordingly, the metal extending pieces 3033 can be rotated downwardly via a shaft 3032 by a rotation mechanism simultaneously. Therefore, the metal extending pieces 3033 can contact the metal conducting piece 3061 on the power input region 306, so that the first foldable plug 303 is at a conducting position and electrically connected with the power input region 306. When the first foldable plug 303 is rotated downwardly and received in the first slot 301, the metal extending pieces 3033 of the first foldable plug 303 is separated from the metal conducting piece 3061 on the power input region 306. Therefore, the first foldable plug 303 is at a non-conducting position and is not electrically connected with the power input region 306. Also, the second foldable plug 304 can be posited at the conducting or non-conducting position in the same manner as described above.

In addition, the metal conducting piece 3061 can also be set on the metal extending piece 3033 (not shown). When the foldable plug is rotated to the conducting position, the metal conducting piece on the metal extending piece can contact the power input region, so that the foldable plug is electrically connected with the power input region.

In the present embodiment, the first foldable plug 303 and the second foldable plug 304 are rotated by the rotation mechanism with the shaft. However, other designs providing rotation mechanisms for the first foldable plug 303 and the second foldable plug 304 are incorporated herein for reference. Moreover, the cover 305 in the present embodiment is slid in a set of trenches (not shown) on the main body 30. Of course, other designs for the cover 305 to slide on the main body 30 are also incorporated herein for reference.

Please refer to FIG. 3 and FIG. 4. When the cover 305 is slid on the first slot 301, the cover 305 partially or completely covers the first foldable plug 303 received in the first slot 301, so that the first foldable plug 303 cannot be rotated upwardly to the conducting position. In the same time, only the second foldable plug 304 can be rotated upwardly to the conducting position. In other words, when the cover 305 is slid on the first slot 301, only the second foldable plug 304 can be rotated upwardly to the conducting position, while the first foldable plug 303 can only be posited at the non-conducting position. Therefore, the danger of electric shock can be prevented. Also, when the cover 305 is slid on the second slot 302, the cover 305 partially or completely covers the second foldable plug 304 received in the second slot 302, so that the second foldable plug 304 cannot be rotated upwardly to the conducting position. In the same time, only the first foldable plug 303 can be rotated upwardly to the conducting position. In other words, when the cover 305 is slid on the second slot 302, only the first foldable plug 303 can be rotated upwardly to the conducting position, while the second foldable plug 304 can only be posited at the non-conducting position. Therefore, the connector having plural foldable plugs provided by the present invention can completely prevent the danger of electric shock.

Figure 5:
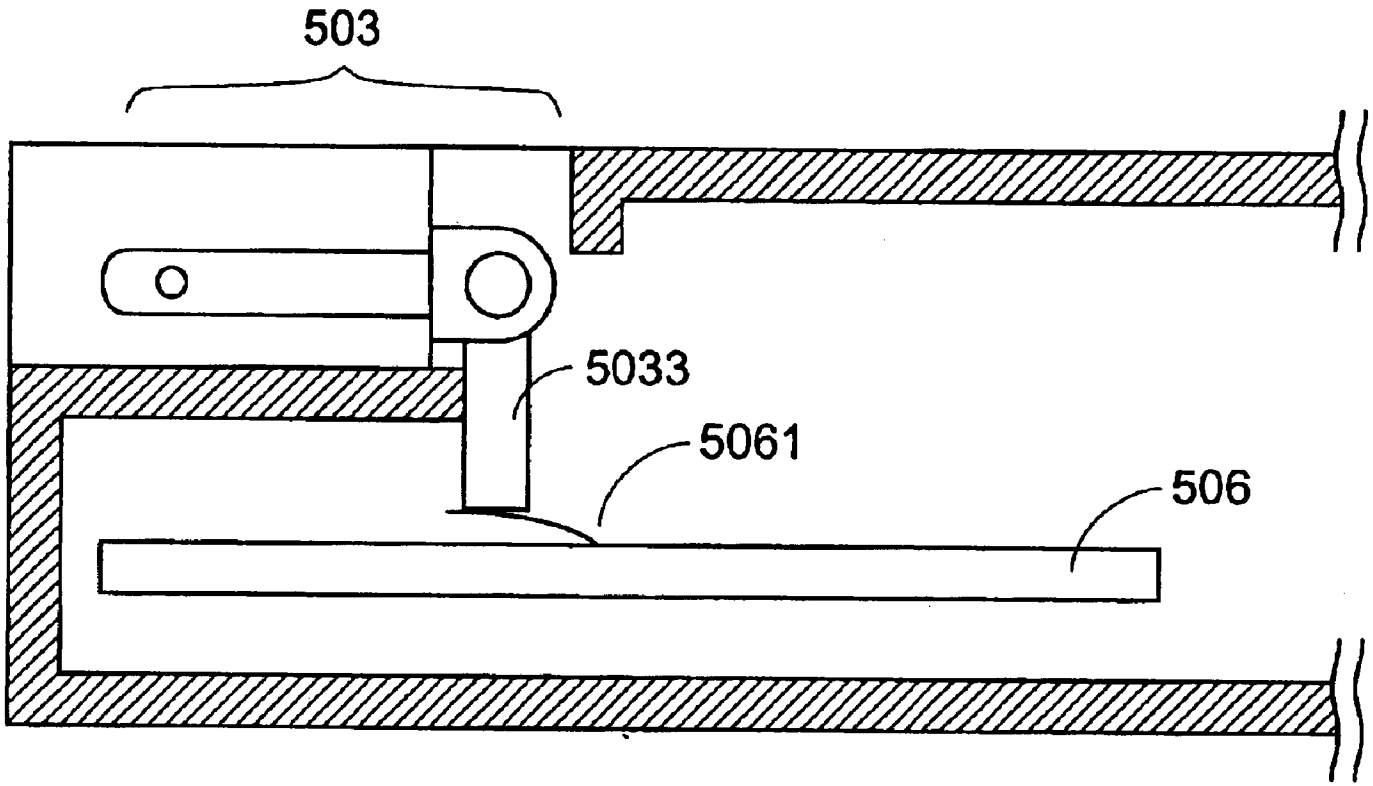
FIG. 5 is a schematic view showing a side cross-section of the connector according to another preferred embodiment of the present invention.

Furthermore, the first foldable plug and the second foldable plug can also be designed to posit at the conducting positions constantly. Please refer to FIG. 5 showing a side cross-sectional view of the connector having two foldable plugs according to another preferred embodiment of the present invention. The metal extending pieces 5033 of the first foldable plug 503 and the second foldable plug (not shown) constantly contact the metal conducting piece 5061 on the power input region 506. When the cover is slid on the first slot or the second slot receiving the first foldable plug or the second foldable plug, the cover can also prevent one of the first foldable plug and the second foldable plug from contacting the external environment, even the first foldable plug and the second foldable plug are both posited at the conducting positions. Therefore, the danger of electric shock can also be prevented completely.

In conclusion, the connector having plural foldable plugs provided by the present invention includes a cover which protects one foldable plug from being used when the other foldable plug is used, and can thus completely prevent the danger of electric shock. Therefore, the present invention exhibits a great industrial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A connector having plural foldable plugs, comprising:

a main body having a first slot and a second slot thereon and a power input region therein;

a first foldable plug received in said first slot and having one end connected with plural first metal extending pieces for contacting with a resilient conductive piece of said power input region when said first foldable plug is rotated upwardly and being separated from said resilient conductive piece when said first foldable plug is folded into said first slot;

a second foldable plug received in said slot and having one end connected with plural second metal extending pieces for contacting with said resilient conductive piece of said power input region when said second foldable plug is rotated upwardly and being separated from said resilient conductive piece when said second foldable plug is folded into said second slot; and a cover positioned within a sidewall of said main body to slide between said first slot and said second slot, for covering one of said first slot and said second slot so as to protect said first foldable plug from being used when said cover slides on said first slot, and protect said second foldable plug from being used when said cover slides on said second slot.

2. The connector according to claim 1 wherein said connector is an adapter.

3. The connector according to claim 1 wherein said connector is a power supply.

4. The connector according to claim 1 wherein said connector is a charger.

5. The connector according to claim 1 wherein said metal extending piece is a flat bar or a cylinder.

6. The connector according to claim 1 wherein said first foldable plug and said second foldable plug have shafts, respectively, thereby rotating in said main body.

7. The connector according to claim 1 wherein said first foldable plug is an AC or a DC plug.

8. The connector according to claim 1 wherein said second foldable plug is an AC or a DC plug.

9. The connector according to claim 1 wherein said main body further comprises a trench for said cover to slide therein.

* * * * *